United States Patent [19]

Mei

[11] Patent Number: 5,027,707

[45] Date of Patent: Jul. 2, 1991

[54] ELECTRIC PRIMER WITH REDUCED RF AND ESD HAZARD

[75] Inventor: George C. Mei, Creve Coeur, Mo.

[73] Assignee: Olin Corporation, Stamford, Conn.

[21] Appl. No.: 348,441

[22] Filed: May 8, 1989

[51] Int. Cl.[5] ..... F42C 19/12

[52] U.S. Cl. ..... 102/202.8; 102/202.9

[58] Field of Search ..... 102/202.2, 202.3, 202.5, 102/202.8, 202.9

[56] References Cited

U.S. PATENT DOCUMENTS

| | | | |
|---|---|---|---|
| 2,754,757 | 11/1951 | MacLeod | 102/28 |
| 2,918,871 | 8/1953 | Taylor | 102/70.2 |
| 2,942,546 | 3/1950 | Liebhafsky et al. | 102/28 |
| 2,960,032 | 11/1960 | Sahlin | 102/202.8 |
| 3,090,310 | 5/1960 | Peet et al. | 102/46 |
| 3,118,375 | 4/1960 | Jasse | 102/28 |
| 3,125,954 | 3/1964 | Vilbajo | 102/202.8 |
| 3,155,553 | 10/1961 | Taylor et al. | 149/21 |
| 3,320,104 | 5/1967 | Stadler et al. | 149/24 |
| 3,390,636 | 7/1968 | Perkins et al. | 102/202.8 |
| 3,793,920 | 2/1974 | Sheran | 86/1 |
| 3,799,055 | 3/1974 | Irish, Jr. et al. | 102/100 |
| 3,828,677 | 8/1974 | Kaszupski | 102/46 |
| 3,940,297 | 2/1976 | Bolza | 149/42 |
| 4,011,115 | 3/1977 | Harris et al. | 149/22 |
| 4,070,970 | 1/1978 | Scamaton | 102/28 |
| 4,105,480 | 8/1978 | Sterling et al. | 149/40 |
| 4,156,390 | 5/1979 | Ferguson et al. | 102/202.8 |
| 4,329,924 | 5/1982 | Lagofun | 102/202.8 |
| 4,380,958 | 4/1983 | Betts | 102/202.2 |
| 4,386,567 | 6/1983 | Ciccone et al. | 102/202.5 |
| 4,522,665 | 6/1985 | Yates et al. | 149/21 |
| 4,566,921 | 1/1986 | Duguet | 149/22 |
| 4,644,863 | 2/1987 | Bender et al. | 102/202.5 |

FOREIGN PATENT DOCUMENTS

| | | | |
|---|---|---|---|
| 957735 | 2/1957 | Fed. Rep. of Germany | 102/202.5 |
| 21636 | 9/1965 | Japan | 102/202.2 |
| 812257 | 4/1959 | United Kingdom | 102/202.5 |
| 821586 | 10/1959 | United Kingdom | 102/242.5 |

*Primary Examiner*—Stephen C. Bentley
*Assistant Examiner*—Stephen Johnson
*Attorney, Agent, or Firm*—John R. Wahl

[57] ABSTRACT

An electric primer using an intrinsic conductive pyrotechnic mixture is improved by the addition of a carbon layer between the inner and outer electrodes and the mixture. The carbon layer provides a parallel resistive current path between the electrodes in addition to the path through the conductive mixture. The addition of a carbon layer also increases the operable temperature range of the primer. The high energy firing threshold of the intrinsically conductive pyrotechnic mixture and the additional dissipative current path through the carbon layer coact to further reduce the sensitivity of the primer to RF radiation and ESD hazards.

17 Claims, 1 Drawing Sheet

ELECTRIC PRIMER WITH REDUCED RF AND ESD HAZARD

Figure 1:
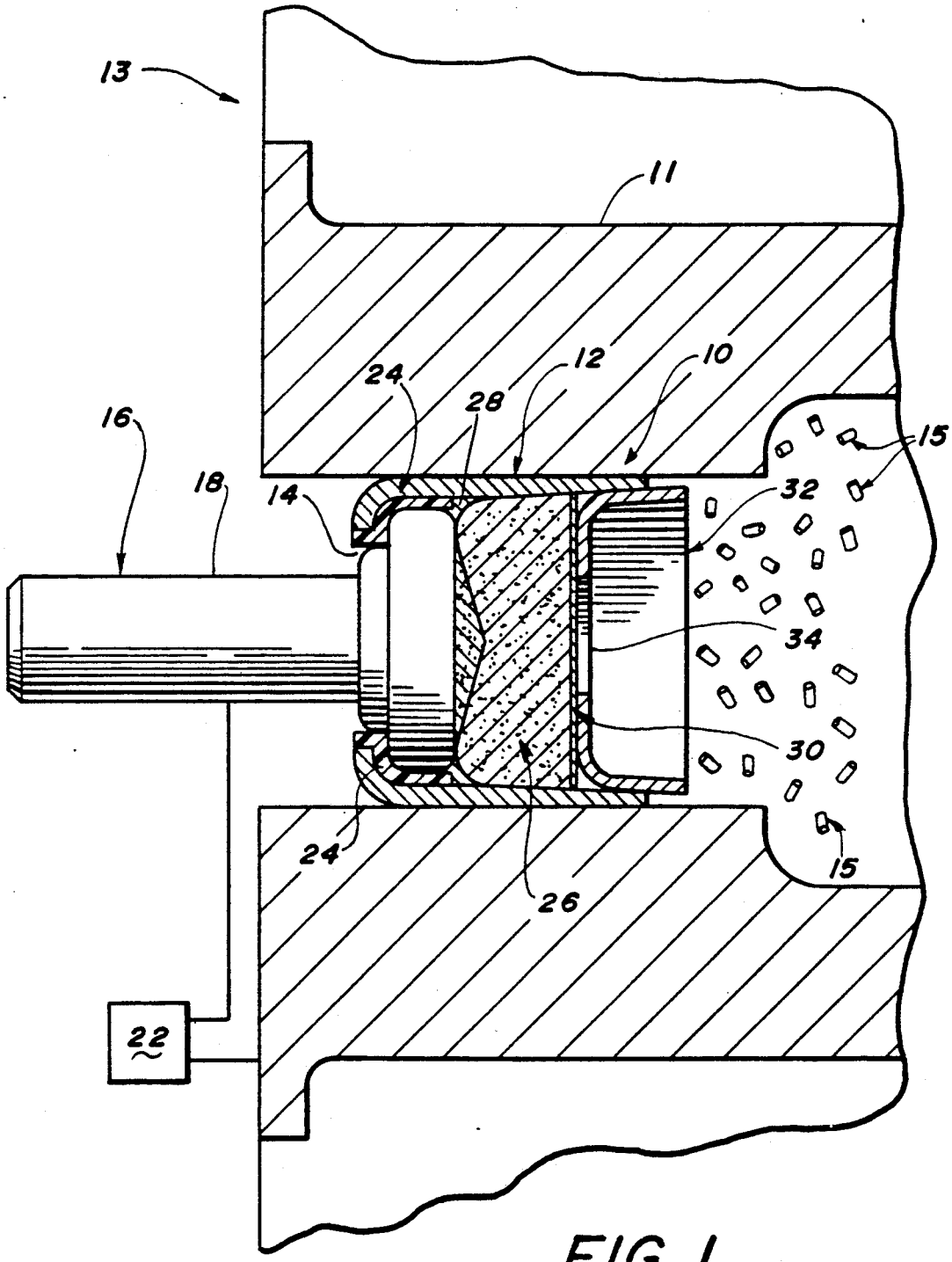

This invention relates generally to electrical primers and more particularly to an electrical primer having an intrinsically conductive pyrotechnic mixture adapted for use in airbag inflators.

Many types of electric primers are known. These electric primers generally fall into two categories. The first involves the use of a bridge wire in conjunction with an explosive primer mixture. In this type, an applied voltage causes the bridge wire to resistively heat to a point where ignition occurs. Another variation of the bridge wire device is an exploding bridge wire primer. In this device the voltage applied is high enough to cause almost instantaneous vaporization of the bridge wire creating a plasma. The shock wave produced by this plasma detonates a high explosive. These devices are relatively insensitive to low shock levels, but have the disadvantage of requiring a relatively large and cumbersome voltage source.

The second type of electric primer involves the use of an explosive primer mixture having a conductive substance such as noble metal filings, metal powder, or some form of carbon such as carbon black mixed therein to provide many small conduction paths. Like the bridge wire primer, a sufficient current passing through the conducting powder causes localized heating and/or a spark which in turn detonates the explosive primer mixture.

In the case of bridge wire devices, the bridge wire can tolerate a generally high amount of radio frequency (RF) radiation or electrostatic discharge (ESD) stimulus. However, bridge wire devices have a tendency to burn without detonating the explosive mixture thus causing misfires. To remedy this, redundancy is usually employed requiring a multitude of bridge wires in contact with the mixture. This substantially increases the manufacturing problems. Secondly, bridge wire devices require more parts and more steps in assembly and thus are more costly to produce than conductive mix type devices.

In contrast, the prior art conductive mixture type electric primers provide an enormous number of redundant electrically conductive paths and thus theoretically may be much more reliable. Electric primers utilizing a conductive mixture composition generally include an explosive component and a finally divided noble metal powder or carbon black. One such device is disclosed is U.S. Pat. No. 3,090,310 issued to Peet et al. The conductive mixture in Peet et al comprises zirconium, zirconium hydride, barium nitrate, lead peroxide, and pentaethyeride tetranitrate (PETN). This is an explosive primer mixture having a substantial percentage of PETN, approximately 20%. This mixture requires a substantial input of energy for detonation and is designed for use in rapid fire guns requiring a high firing voltage to preclude premature firing.

Other examples of electric primers utilizing conductive mixtures are those described in U.S. Pat. Nos. 3,793,920, 3,320,164, and 3,155,553. These patents each disclose a composition having a finely divided detonating material such as lead azide or other explosive and either carbon in some form or a finely divided noble metal powder. These metals and/or carbon act as conductors and do not act primarily as a fuel and therefore their content is minimized in order to achieve the desired results.

Since these mixtures contain initiating explosives such as lead styphnate and lead azide, there is a substantial explosive hazard during manufacture and handling. In addition, when designed to operate at relatively low voltages, immunity to radio frequency radiation and electrostatic discharge is minimal.

A conductive mixture without an explosive, utilized in an electric primer, is disclosed in U.S. Pat. No. 4,070,970 issued to Scamaton. This patent discloses an electric ignitor having good resistance to low voltage accidental triggering. The mixture disclosed in this patent is a mixture of copper oxide and aluminum powder. This a thermite mixture having a pre-breakdown DC resistance of at least 1 megohm. The mixture requires a relatively high initiation voltage and relies upon breakdown of the dielectric material presented by copper oxide. In fact, this mixture requires a voltage of approximately 1700 volts applied to achieve dielectric breakdown and ignition. Accordingly, this mixture is not useful at low voltages.

Another primer mixture is disclosed in U.S. Pat. No. 4,522,665 issued to Yates et al. The primer mixture disclosed in the Yates Patent is a percussive priming mixture whose composition is similar to that of the present invention as will be subsequently described. However, this patent teaches use of a mixture of titanium and potassium perchlorate not in an electric primer application, but in a percussive primer where a substantial level of impact energy is required for ignition. The Yates Patent does not teach the use of titanium and potassium perchlorate in electric primer applications at low voltages. In fact, this patent specifically teaches that this mixture would require the use of a separate heating element for electric ignition as in bridge wire primers.

The electrically conductive primer mixtures of the prior art are not found to be entirely satisfactory for use in automotive airbag inflators for several reasons. First, the firing voltage threshold required in an automotive application is preferably on the order of 9 to 12 volts. Most prior art electric primers require voltages on the order of 80 volts or higher. At low voltages, the prior art primer mixtures are generally overly sensitive to discharge of stray electrostatic energy. In addition, the presence of an explosive material such as lead styphnate and lead azide is undesirable. The hazard of manufacturing and handling these explosives is substantial. Accordingly, a mixture which minimizes or eliminates the use of explosive materials is advantageous for use in airbag inflators in automotive restraint systems.

A unique intrinsically conductive pyrotechnic primer mixture for an electric primer that does not utilize a separate heating element is disclosed in my copending patent application Ser. No. 07/348,440, U.S. Pat. No. 4,994,125 issued Feb. 19, 1991, assigned to the assignee of the present invention and filed on even date herewith. The present invention utilizes the same mixture and is an improvement thereover.

It is an object of the present invention to provide an low voltage electric primer utilizing an intrinsically conductive pyrotechnic mixture which has enhanced resistivity to radio frequency radiation and electrostatic discharge.

It is another object of the present invention to provide an improved electric primer utilizing an intrinsically conductive pyrotechnic mixture to reliably ignite the propellant gas generator utilized in a airbag inflator in an automotive passive restraint system having an improved range of thermal stability.

These and other objects of the present invention are advantageously achieved in an electric primer using an intrinsic conductive pyrotechnic mixture by the addition of a carbon layer between the electrodes and the mixture as described below. The improved electric primer with an intrinsic conductive pyrotechnic mixture in accordance with the present invention is specifically designed for use in a gas generator which is in turn utilized in an automatic airbag inflator for an automobile passive restraint system.

The electric primer includes a cup shaped outer electrode having a central bore through the bottom of the cup and an inner button shaped electrode disposed within the cup and spaced from the outer electrode. The inner electrode has a terminal portion extending through the bore, out of the outer electrode for connection to an external electrical power source, typically the vehicle battery. An insulator sleeve is placed between the button portion of the inner electrode and the outer electrode thus spacing and separating the electrodes from one another. A pyrotechnic mixture of a metal powder fuel, an alkaline oxidizer, and a sensitizing fuel are compacted together, preferably at a pressure of at least 3000 psi, within the cup. A thin layer of carbon is disposed between the mixture and the electrodes. This layer of carbon communicates between the inner and outer electrodes over the end surface of the insulator.

The electric primer is ignited by passing nominal vehicle battery voltage of 9 to 12 volts across the two electrodes. This impressed voltage causes a current to flow through the coating and the conductive mix, igniting the mix, thus causing ignition of a propellant such as sodium azide within the gas generator.

The metal fuel may range between 15% and 50% dry weight with the oxidizer between 75% and 40% dry weight, with the remainder being made up of one or more sensitizer fuels such as boron or lead thiocyanate. Preferably, the pyrotechnic mixture consists of essentially titanium metal powder in about 27% dry weight, potassium chlorate in about 68% dry weight, and 5% dry weight of boron as a secondary fuel sensitizer.

The coaxial, symmetrical arrangement of the cup shaped outer electrode and the axially located inner electrode within the cup provides some inherent RF radiation immunity over parallel twin lead electroexplosive devices such as squibs. This shielding is primarily due to the coaxial electrode arrangement with the pyrotechnic mix being located within the cup.

The addition of the carbon layer in the primer according to the present invention between the electrodes and the mixture provides shunt dissipative paths between the electrodes. The carbon layer thus provides extra RF and ESD protection. In addition, the carbon layer provides an alternative resistive heating path during the application of firing voltage to ignite the mix.

The primer with an intrinsic conductive pyrotechnic mixture alone has a relatively stable electrical resistance below approximately 70° C. However, the primer with the intrinsic conductive mixture alone undergoes a resistance shift at approximately 70° C. The presence of the carbon layer in the primer according to the present invention effectively reduces the amount of shift. This carbon layer thus extends the stable resistivity range of the primer to well above 70° C.

These and other objects, features and advantages of the present invention will become readily apparent upon a reading of the following detailed description when taken in conjunction with the drawing and appended claims.

FIG. 1 is a fragmentary sectional view of a preferred embodiment of an electric primer in accordance with the present invention disposed in a gas generator in a vehicular airbag inflator.

Turning now the drawing, an electric primer 10 according to one preferred embodiment of the present invention shown FIG. 1. The electric primer 10 is designed to be utilized in a gas generator 11 for an automatic airbag inflator 13 in an automobile passive resistant system. The electric primer 10 is operative at a nominal vehicle battery voltage to ignite a propellant 15 such as sodium azide within the gas generator 11.

Electric primer 10 includes a cup shaped tubular outer electrode body 12 made of a conductive metal such as copper, brass, steel, or aluminium. The cup shaped body 12 has a central bore 14 through the bottom of the cup body 12. An inner electrode 16 having a terminal stud portion 18 and a button portion 20 is positioned in cup 12 with the terminal stud portion 18 extending out of cup 12 through bore 14.

A power supply such as vehicle battery is shown schematically externally connected to stud portion 18 and outer cup 12. The power supply 22 applies a voltage across electrodes 12 and 16 to cause electrical current to flow between the electrodes as described below. The power supply 22 has a nominal voltage range from 9 to 12 VDC.

Spaced between and separating button portion 20 of inner electrode 16 from outer electrode 12 is an insulator sleeve 24. Insulator 24 may be a ceramic, plastic, or glass material and is sleeve shaped so as to encircle and space the button portion 20 from the cup shaped outer electrode 12.

Placed within the cup shaped outer electrode 12 and over the button portion 20 is an intrinsically conductive pyrotechnic mixture 26. This mixture consists essentially of a powdered metal fuel, an alkaline chlorate oxidizer, and at least one secondary fuel which acts as a sensitizer. The presence of a fuel sensitizer fine tunes the firing threshold of the mixture as will be subsequentially described.

Deposited on the button portion 20 and extending across the end of insulator 24 and on a portion of the inner wall of cup 12 is a thin layer of carbon 28. The layer 28 is deposited prior to the addition of the mixture 26 to cup 12. The layer 28 is thus sandwiched between the inner electrode 16 and the mixture 26.

Over the mixture 26 in cup 12 is a closure wad 30. This closure wad 30 may be made of any suitable material such as paper, nitrocellulose, or cellulose acetate. The primary purpose of closure wad 30 is to retain the mixture 26 in the cup 12 and separate the primer mixture 26 from the propellant (not shown) to be ignited.

Frictionally disposed in cup shaped outer electrode 12 and against closure wad 30 is a support cup 32 which has a centrally located flash hole 34 therethrough for use as a flame exit. The support cup 32 prevents the outer electrode 12 from collapse when the electrical primer is pressed into a metal cavity (not shown) in the cartridge or gas generator casing. The support cup 32 is frictionally secured within the outer cup 12.

The intrinsic conductive pyrotechnic mixture 26 consists essentially of about 15% to 50% dry weight of a finely divided metal powder fuel, about 75% to 40% dry weight of an alkaline oxidizer, and about 2% to 15% dry weight of at least one secondary sensitizing fuel mixed together. The mixture 26 may also include a binder to hold the mixture together in certain applications.

The mixture 26 may be compacted to establish particular desired resistivity values, total energy required for ignition and predictable repeatability values that may be required for a specific design.

The metal fuel in the mixture may be any oxidizable metal powder which can serve as the primary fuel and provide a conductive path for electrical current through the mixture. More specifically, the metal powder fuel is preferably selected from the group consisting essentially of titanium, zirconium, uranium, and aluminum. A specifically preferable metal powder fuel for use in the mixture 26 for application in automotive airbag inflater electric primers is titanium.

The alkaline oxidizer advantageously utilized in the mixture 26 may be an alkaline oxidizer selected from the group consisting essentially of an alkali metal or an alkaline earth metal chlorate or perchlorate. Both chlorates and perchlorates must be used with care as they are very reactive and verge on being an explosive themselves. Illustrative examples in this group include potassium, sodium, and calcium chlorate. More specifically, a preferred oxidizer for use in the mixture 26 for automotive airbag inflator primers is potassium chlorate.

The secondary fuel and sensitizer utilized in the mixture 26 is preferably selected from the group consisting essentially of boron, sulphur, and lead thiocyanate. One specifically preferable sensitizer for the mixture 26 for automotive airbag inflator primers is boron. Alternatively, another preferred embodiment of the mixture 26 includes both boron and lead thiocyanate as secondary fuel sensitizers.

The mixture is preferably formulated with 20%–45% dry weight titanium metal powder, 75%–40% dry weight potassium chlorate, and 2%–15% dry weight secondary fuel sensitizer. In addition, a binder material of 1%–3% dry weight may be added. Finally, an additional fuel sensitizer may be utilized such as lead thiocyanate to further adjust the sensitivity and firing threshold of the mix for a particular design and for a given operating temperature range.

One exemplary preferred embodiment of the mixture comprises 27% dry weight titanium metal powder, 68% dry weight potassium chlorate, and 5% dry weight boron. This composition, compacted to about 3000 psi within cup 12 ignites readily when a voltage of 9–12 volts is applied to the electrodes 12 and 16 via the power supply 22. The resistance of the primer according to the present invention using this mixture composition is about 2 ohms.

In order to obtain repeatability and specific desired resistance and total energy input values in a particular design application, the mixture 26 is compacted to at least 1000 psi. Compaction ensures that the mixture is in firm electrical contact with the carbon layer and the electrodes used to pass electrical current through the primer mixture to cause ignition. Preferably, for applications at low voltages such as are utilized in automobiles, the mixture is compacted at a pressure of between about 3000 psi and 150,000 psi using conventional primer mix compaction techniques. The intrinsically conductive pyrotechnic mixture 26 is compacted within the outer cup 12 after assembly of the inner electrode 16 and insulator 24 therein and deposition of the carbon layer 28.

The presence of a secondary fuel sensitizer such as boron and/or lead thiocyanate is not necessary for ignition of the intrinsically conductive pyrotechnic mixture. However, the presence of these sensitizers lowers the total energy required for ignition. For example, the mixture including 5% boron readily ignites under an applied energy of about 0.272 Joules when compacted to about 3000 psi. In contrast a mixture without any sensitizer requires a substantially higher energy level for ignition.

The titanium metal in the mixture not only serves as an conductive material but also serves as the major fuel. No primary explosive is used in the mixture. Finally, the voltage sensitivity of the mixture is not effected by the absence of a secondary fuel or sensitizer. Only the total energy required to ignite the mixture is greater where the sensitizer is absent.

The total energy required to ignite the mixture 26 is relatively high while the resistivity, about 2 ohms, of the primer 10, is low. Because of the relatively high energy required for ignition, the mixture is substantially resistant to the effects of RF radiation and ESD.

The thickness of the carbon layer 28, as well as the concentration of sensitizers, as discussed above, may be varied to optimize the firing threshold of the electric primer. In addition, the presence of the carbon coating 28 increases the resistance of the electric primer of the present invention to radio frequency radiation and electrostatic discharge. However, the resistance of the primer to these external effects is primarily due to the relatively high total energy input required by the mixture for ignition. The presence of the carbon layer 28 additional shunt provides conduction paths for minor radio frequency and electrostatic discharges without significantly raising the temperature of the intrinsically conductive mix to the firing threshold. Thus, the presence of the carbon layer further reduces the RF and ESD hazard in the improved electrical primer according to the present invention.

The carbon layer also can be used to adjust the current heating of the mixture and thus further adjust the ignition threshold of the conductive mixture.

The primer 10 with the intrinsically conductive pyrotechnic mixture 26 above described has a relatively constant specific resistivity over the normal range of environmental temperatures. However, the primer without a carbon layer does have an upper temperature limitation of about 70 C. A resistant shift occurs at about this temperature which causes the voltage sensitivity of the mixture to change. The addition of the carbon layer 28 in the electric primer 10 according to the present invention raises the temperature at which this resistant shift occurs reducing the amount of resistant shift dramatically.

The improved primer 10 according to the present invention having an intrinsically conductive pyrotechnic mixture 26 and a thin carbon coating 28 between the electrodes and the mixture may also be advantageously employed in other electric primer applications than as specifically described herein. What has been described is a preferred embodiment of the invention. Variations and equivalents are within the scope of the present invention. The foregoing description is to be clearly understood as being given by way of illustration and example only. The spirit and scope of this invention is intended only to be limited by the scope of the following appended claims.

What is claimed is:

1. In an automatic airbag inflator utilizing a gas generator in an automobile passive restraint system, an electric primer operative at nominal vehicle battery voltage for igniting a propellant in said gas generator comprising:

a cup shaped outer electrode having a central bore therethrough;

an inner button shaped electrode having a terminal portion extending through said bore;

an insulator sleeve spaced between and separating said electrodes;

a layer of carbon over said inner electrode and a portion of said insulator sleeve and a portion of said outer electrode so as to form a resistance path through said layer between said electrodes; and an intrinsic conductive pyrotechnic mixture within said cup shaped outer electrode and over said layer, said mixture consisting essentially of a powdered metal fuel, an alkaline chlorate oxidizer, and a sensitizer fuel, said mixture reacting exothermically when said nominal battery voltage is applied between said electrodes through said carbon layer and said mixture to ignite said propellant in said gas generator.

2. The electric primer according to claim 1 wherein said mixture is a compacted mixture compressed within said cup shaped electrode at a pressure of between 3000 psi to 150,000 psi.

3. The electric primer according to claim 2 wherein said metal fuel is titanium.

4. The electric primer according to claim 3 wherein said alkaline chlorate oxidizer is potassium chlorate.

5. The electric primer according to claim 4 wherein said mixture is about 27% by weight titanium and 68% by weight potassium chlorate.

6. The electric primer according to claim 2 wherein said sensitizer fuel is boron.

7. The electric primer according to claim 6 wherein said primer has an electrical resistance of about 2 ohms.

8. The electric primer according to claim 2 wherein said metal fuel is between 15% by weight and 50% by weight of said pyrotechnic mixture.

9. The electric primer according to claim 2 wherein said oxidizer is between 40% by weight and 75% by weight of said pyrotechnic mixture.

10. The electric primer according to claim 2 wherein said sensitizer fuel is lead thiocyanate.

11. An electric primer adapted for use in a automobile airbag inflator to ignite a propellant in a gas generator, said primer comprising:

a cup shaped outer electrode;

an inner electrode;

an insulator space between and separating said electrodes;

an intrinsically conductive pyrotechnic mixture consisting essentially of a powdered metal fuel, an alkaline chlorate oxidizer, and a sensitizer fuel within said outer electrode communicating between said electrodes; and a layer of carbon disposed between said mixture and said electrodes and over said insulator communicating with said mixture and said electrodes.

12. The electric primer according the claim 11 wherein said mixture is a compacted mixture compressed within said outer electrode at a pressure between 3000 psi and 150,000 psi.

13. The electric primer according to claim 11 wherein said metal fuel is titanium.

14. The electric primer according claim 12 wherein said alkaline chlorate oxidizer is potassium chlorate.

15. The electric primer according to claim 11 wherein said sensitizer fuel is Boron.

16. An electric primer comprising:

a cup shaped outer electrode;

an inner electrode;

an insulator spaced between and separating said electrodes;

an intrinsically conductive pyrotechnic mixture consisting essentially of a powdered metal fuel, an alkaline chlorate oxidizer, and a sensitizer fuel within said outer electrode communicating between said electrodes; and a layer of carbon disposed between said mixture and said electrodes and over said insulator and communicating with said mixture and said electrodes, said mixture being about 27% by weight titanium and 68% by weight potassium chlorate.

17. The electric primer according to claim 16 wherein said primer has an electrical resistance of about 2 ohms.

* * * * *